United States Patent [19]

Boretsky et al.

[11] Patent Number: 4,974,762

[45] Date of Patent: Dec. 4, 1990

[54] ARMBAND-SUPPORTED LIQUID REFRESHMENT CARRIER

[76] Inventors: Bruce L. Boretsky, 2539 26th St. Dr. SE., Cedar Rapids, Iowa 52403; Thomas W. Lidd, 1709 29th St. NW., Cedar Rapids, Iowa 52405

[21] Appl. No.: 451,086

[22] Filed: Dec. 15, 1989

[51] Int. Cl.[5] ..... A45F 3/18

[52] U.S. Cl. ..... 224/148; 224/222

[58] Field of Search ..... 224/148, 222, 224, 226, 224/227

[56] References Cited

U.S. PATENT DOCUMENTS

| | | | |
|---|---|---|---|
| 4,220,302 | 9/1980 | Hampton et al. | 224/148 |
| 4,432,477 | 2/1984 | Haidt et al. | 224/222 |
| 4,489,867 | 12/1984 | Schwemberger | 224/222 |
| 4,500,019 | 2/1985 | Curley, Jr. | 224/222 |
| 4,509,667 | 4/1985 | Meldrum | 224/250 |
| 4,736,876 | 4/1988 | Kriss | 224/148 |
| 4,763,821 | 8/1988 | Powell | 224/267 |
| 4,852,781 | 8/1989 | Shurnick | 224/148 |
| 4,913,326 | 4/1990 | Echelson | 224/222 |

OTHER PUBLICATIONS

Armband Carrier (Jog Man), *Runner's World,* Oct. 1989, p. 113, Advertisement.

The Water Belt, *Runner' World,* Oct. 1989, p. 113, Advertisement.

*U.S.A. Today,* Nov. 9, 1989, Sports p. 12c, "Insulated Pouch Keeps Hands Free, Liquids Handy", Article.

*Primary Examiner*—Renee S. Luebke

*Attorney, Agent, or Firm*—Simmons, Perrine, Albright & Ellwood

[57] ABSTRACT

A dispenser for liquid refreshment is removably carried in a pocket attached to an armband. The armband is adapted to be worn on an upper arm of a person engaged in a continuous physical activity such as running. The dispenser, a flask of oval cross section has an upper closure and filler cap including a squirting spout. While being engaged in the activity such as running, the wearer of the armband and pocket may remove the flask from the pocket and use all or a portion of the liquid by squirting the liquid into an opened mouth. The pocket includes a shorter, rectangular outer wall and a longer rectangular inner wall which is disposed adjacent and is attached to the armband in a central portion of its adjacent major surface. The outward facing surface of the inner wall serves as a guide surface to reinsert the flask into the pocket. The inner wall is of a length substantially equal to the length of the flask. Thus, when the flask is inserted into the pocket, the inner wall is a protective interface between the runner's arm and the flask. The oval cross-sectional shape of the flask shapes the edges of the pocket to cause such edges to become spaced from the arm of the person wearing the armband. The spacing is sufficient to prevent abrasive contact as a result of relative movement between the edges of the pocket and the arm of the wearer.

9 Claims, 1 Drawing Sheet

ARMBAND-SUPPORTED LIQUID REFRESHMENT CARRIER

BACKGROUND OF THE INVENTION

1. Field of the Invention

The invention relates generally to a liquid refreshment carrier, carried by a person, and more particularly to such a carrier which includes a receiving pocket for removably holding a liquid dispenser.

2. Discussion of the Prior Art

Prior art relating to means for providing liquid refreshment to a person engaged in an athletic activity, such as running, for example, shows a waist-carried liquid container which is accessed through a flexible conduit carried in the mouth of the runner. One disadvantage which may be perceived by the user of such a system relates to the water column height that needs to be overcome to draw liquid from the dispenser. While this is not an impossible task, it does tend to impose a burden on a person while engaged in running during which time the person's lungs are working to the utmost limit in supplying oxygen to the body. While such prior art makes the liquid most readily available to the runner, the effort required to access the available source tends to diminish the benefit of the availability.

Another example of prior art in an insulated water pouch that is carried as a backpack on the back of the user. Also accessed by a tube through a mouthpiece, the backpack supply may still exhibit some of the described drawbacks. However, when used by bicyclists, a typically lowered head posture and a relatively high position of the back may facilitate drinking from the supply without the described discomfort created by vacuum suction on the lungs. Also, typically, a cyclist need not support the weight of the water as a runner would. Hence the added weight of a relatively large water supply does not hinder the cyclist as it would a runner.

In the more general art of carriers of articles, the prior art discloses, for example, a carrier for portable audio devices. The carrier includes an armband which attaches to a person's upper arm. For portable audio devices, such a carrier positions the device at the upper body of the person carrying the device and within easy reach of a cord for earphones, for example. While in use, the audio device need not be removed from its carrier, thereby allowing the person to go about the desired activity, such as running, skiing or the like without removing or reattaching the device.

Another type of armband-held carrier is intended for a camera. The camera needs to be removed from the carrier to be used. Though the camera carrier is intended to be used in conjunction with such physical activities as surfing or skiing, it is to be expected that the person making use of the camera temporarily interrupts the activity to adjust the settings of the camera, to aim and frame the scene or action to be recorded on film.

SUMMARY OF THE INVENTION

It is an object of the invention to provide a liquid refreshment supply which includes a provision for carrying the supply within easy reach of the user while the user is engaged in a physical activivity.

It is another object of the invention to provide a liquid refreshment container to be carried on a limb of its user, the container being removable and replaceable by the user in the course of an ongoing activity by the user.

It is a further object of the invention to provide a supply of liquid which may be carried by a person in an non-encumbering manner for subsequent enjoyment.

It is yet a further object of the invention to provide a portable supply of liquid which can be carried by a runner and which can be dispensed by and for use of the runner without requiring suction for its use.

Accordingly, the invention includes a liquid supply and dispenser in combination with a pocket-type receiver for the supply and dispenser, which pocket-type receiver is attached to a flexible band to be circumferentially attached to a limb of the user.

According to a particular aspect, the invention includes an armband and a pocket attached to and carried by the armband. The flexible armband is particularly adapted to be attached to a user's upper arm. The pocket extends lengthwise substantially perpendicular to the circumferential length of the armband. The pocket features inner and outer substantially adjacent and facing walls. An inner pocket wall lies in contact with the armband across the entire width of the armband and extends above the upper edge of the armband by a preferred distance. The outer pocket wall lies adjacent the inner wall and terminates in an upper edge disposed below an upper edge of the inner wall. The upper edges of the two respective walls define an upper opening of the pocket. An outward facing inner surface portion of the inner wall extending above the outer pocket wall defines a guiding surface which facilitates the insertion of a liquid container into the pocket. The upper edge of the outer wall is strengthened by a reinforcing rim of a thickness greater than the material thickness of the remainder of the outer wall. The reinforced rim serves as an outer guide to further facilitate the insertion of the liquid container into the pocket.

The armband and pocket combination in accordance with the invention is particularly adapted for insertion of a liquid container having a substantially cylindrical shape of elliptical cross section. A base of the container is a downward pointing wedge formed by two converging walls. An upper end of the container terminates in a filler neck, capped by a removable flip-open squirting closure. The pocket structure in accordance with a particular feature of the invention includes a resiliently stretchable retainer band attached to the center of the rim of an outer wall of the pocket. The retainer band is looped in a plane perpendicular to the rim of the outer wall of the pocket, having a loop which extends outward from the plane of the outer pocket.

Particular advantages are derived from the structure and shape of the elements and their cooperative function as further described herein with respect to a particular embodiment of the invention.

BRIEF DESCRIPTION OF THE DRAWINGS

The Detailed Description of the Invention including a detailed description of a preferred embodiment thereof will be best understood when read in reference to the accompanying drawings wherein.

DETAILED DESCRIPTION OF THE INVENTION

Figure 1:
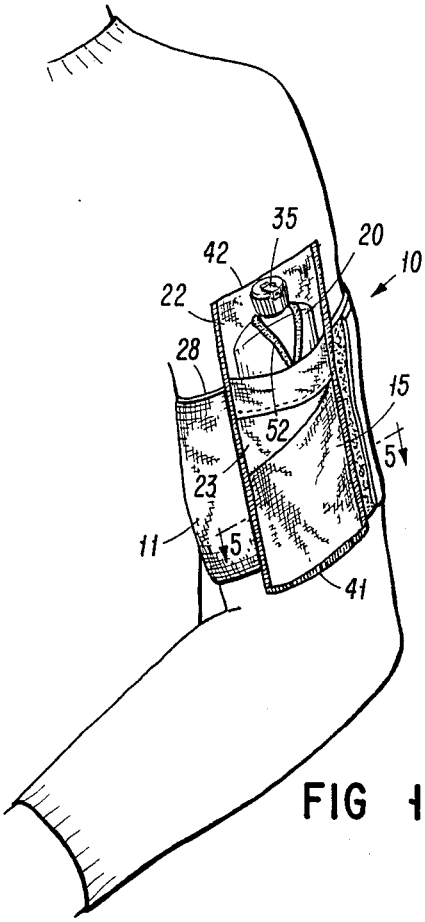
FIG. 1 shows a carrier of a liquid refreshment container attached to an armband and worn by a person in accordance with the invention hereof.
Figure 2:
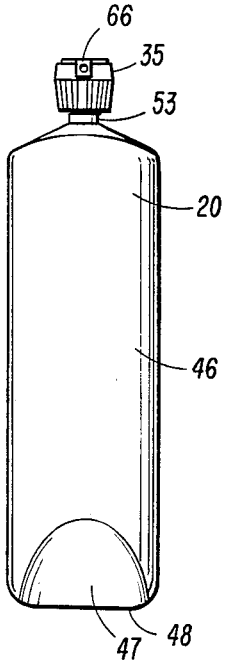
FIG. 2 shows a preferred container to be used in conjunction with the carrier and armband combination in the manner depicted in FIG. 1.

Referring now to FIG. 1, there is shown, in outline, a left shoulder and upper arm of a person wearing a liquid refreshment carrier 10 which carrier 10 is an embodiment of the present invention. In particular, the wearer is supporting the carrier 10 by an armband 11. Attached to the armband 11 is a pocket-type receiver 15 for a liquid container or flask 20. The combination of the armband 11 and the receiver or pocket 15 comprises an apparatus or device enabling a person using same to carry a supply of liquid while such person may be engaged in continuous physical activity such as jogging, running or skiing. Advantages of certain features of the preferred embodiment of the invention as further described herein are particularly useful in the activity of running.

The armband 11 is of a resiliently stretchable material, woven of an elastomeric yarn, such as a spandex. Such material, which is also used in the manufacture of swim suits and gymnastic and aerobic exercise apparel, resiliently expands when stretched to conform under only slight tension to the general curvature of contacted body portions of the wearer. As shown in FIG. 1, the armband 11 has a preferred width of approximately five inches. Though the exact width is not critical, a width of the armband in such a range allows the armband to straddle certain muscle structures located along the central portion of the upper arm of the wearer. The natural curvature of the muscle structure is consequently used to promote comfortable seating of the armband without incurring slippage while the wearer is engaged, for example, in the activity of running. A preferred, open and unstretched length of the armband 11 is about the same as an average circumference of a person's upper arm. An overlap of material needed to attach the armband 11 is substantially equal to a between fifteen and twenty five percent stretch of the spandex material. The armband 11 may be worn in direct skin contact with the arm of the wearer, or the armband may be worn over protective clothing.

The pocket 15 is the receiver and carrier of the flask 20, as shown in FIG. 1. In considering the manner in which the wearer of the armband 11 intends to use the flask 20, certain features of the pocket 15, such as size or shape take on special significance. The structure of the pocket 15 is best explained in reference to FIG 3. The pocket 15 is preferably of a heavier nylon type material, referred to as pack cloth. The pack cloth grade of material is flexible yet has a rigidity or stiffness which allows the material to retain some shape deformation. The shape retention characteristic of the pack cloth has been found to have an advantage of helping to minimize extraneous movement of the flask 20 when the flask is carried in the pocket 15 while a person is exercising or running while wearing the carrier 10. Also, the pack cloth is of light weight and the shape retention characteristic or stiffness allows the pocket 15 to hold its shape and facilitate the insertion and removal of the flask 20, as will be further described herein.

The pocket 15 is of rectangular shape with relatively longer edges 21 extending across the width of the armband 11. The pocket 15 is basically comprised of two major pocket surfaces of the pack cloth or pocket elements referred to herein as an inner wall 22 adjacent the armband 11, and an outer wall 23. In addition, a third, partial wall 24 on the outside of the outer wall 23 forms a key or coin slip pocket 25 as an added convenience.

Figure 3:
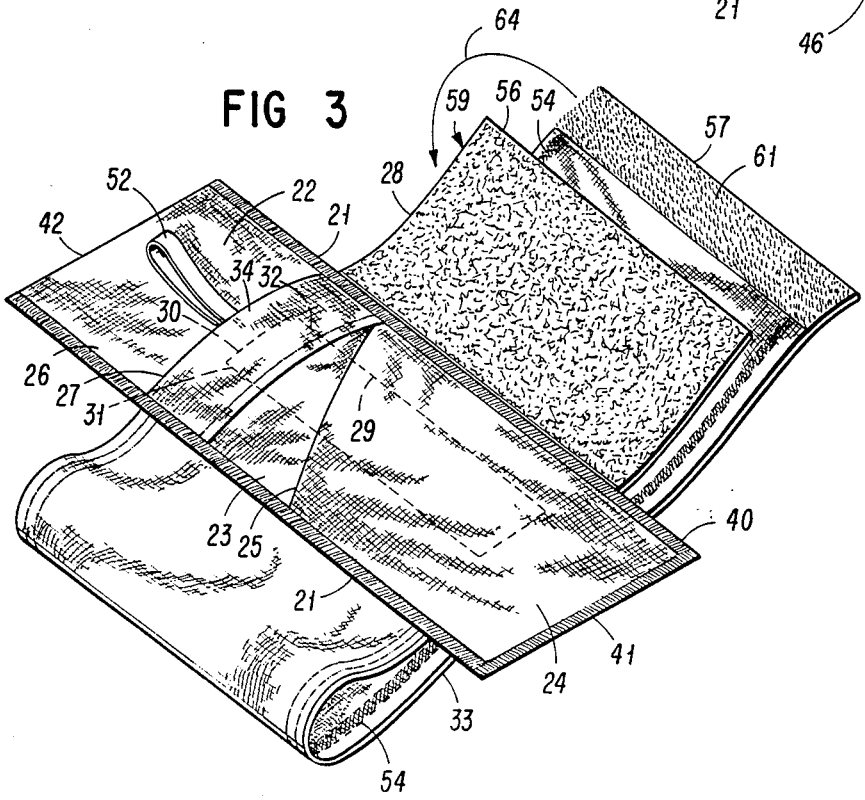
FIG. 3 is a pictorial representation of the armband and carrier of the liquid container shown in FIG. 2, shown apart from its use on a person's arm to more clearly illustrate certain features of the carrier and armband combination.

The inner wall 22 of the pocket 15 is attached directly to the armband 11 as further described herein. As shown in FIGS. 1 and 3, the inner wall 22 is somewhat longer than the outer wall 23, thus having an upper portion 26 extending above an upper edge 27 of the outer wall 23. In attaching the inner wall 22 to the armband 11, the inner wall 22 preferably extends with the upper portion 26 above the upper peripheral edge 28 of the armband 11. The terms "upper" and "lower" and "up" or "down" are made in reference to the position of the armband 11 a it is intended to be worn. Of course, the attachment of the inner wall 22 to the armband 11 may be accomplished in any one of a number of ways. For the preferred embodiment a permanent attachment of the pocket 15 to the armband 11 is desired. Accordingly, the inner wall 22 is sewn to the material of the armband 11. One type of sewing pattern which appears to most advantageously serve its intended purpose consists of a substantially rectangular pattern 29, preferably sewn with what is known as a single needle lock stitch. The pattern 29 is indicated by hidden lines in FIG. 3, showing a top horizontal seam 30 from which extend downward two parallel, spaced seams 31 and 32 which extend downward from the seam 30 spaced inward from and parallel along the longer edges 21 of the pocket 15 substantially across the entire width of the armband 11 to a second horizontal seam adjacent and substantially parallel to a lower peripheral edge 33 of the armband 11. Notably, the spaced, vertical seams 31 and 32 are located well inboard of the longer, parallel edges 21 of the pocket 15. With a preferred overall width of the pocket 15 of three inch, a preferred spacing between the vertical seams 31 and 32 is in the range of one and one-quarter inch, as an example.

Instead of having the pocket 15 sewn onto the armband 11, for an alternate embodiment it is contemplated to fasten the pocket 15 to the armband 11 by removable means, such as typical hook and loop fasteners which are commercially available. It is perceived that certain advantages may be achieved by removably fastening the pocket 15 to the armband 11. One of the advantages, for example, is seen as providing the user with a choice of different sizes of pockets 15 with correspondingly different sizes of flasks 20. Another advantage might be the attachment of a dual pocket for holding more than one of the flasks 20. The use of typical hook and loop fasteners for attaching the pocket 15 or a similarly constructed dual pocket having two adjacent pockets 15 as described herein, would allow a person to first attach the armband 11 as shown in FIG. 1, and then attach the pocket 15 in a manner to conveniently fit around the curvature of the wearer's arm. A major reason for the sewn combination of the pocket 15 and the armband 11 is to achieve a simplicity of structure. It has also been noted that the sewn attachment of the pocket 15 to the armband 11 limits the movement of the pocket 15 with respect to the arm of the wearer. Consequently, the preferred embodiment appears to have certain advantages, among which are simplicity, cost advantage, and convenience.

The outer wall 23 features adjacent its upper edge 27 a rim band 34 of some width. In the preferred embodiment, the width of the rim band 34 is in a range of one inch. The precise width of the rim band 34 is not critical. The purpose of the rim band 34 is to reinforce or stiffen the upper edge 27 of the outer wall 23 to facilitate the insertion of the flask 20.

The overall length of the pocket 15, determined by the length of the flask 20, is preferably defined by the length of the inner wall 22. It is desirable to maintain the length of the pocket 15 to a minimum and at the same time shield the person wearing the refreshment carrier 10 from having direct contact with the top of the flask 20. It has been found that movement of the top of the flask 20 against a person's arm may become distractive or annoying over an extended period of intense exercise such as running. The length of the upper portion 26 of the inner wall 22 is chosen to extend just above the height of a cap or top closure 35 of the flask 20 when the flask is fully inserted into the pocket 15. The upper portion 26 of the inner wall 22, consequently, serves as a shielding interface between the flask 20 and a person's arm.

Figure 4:
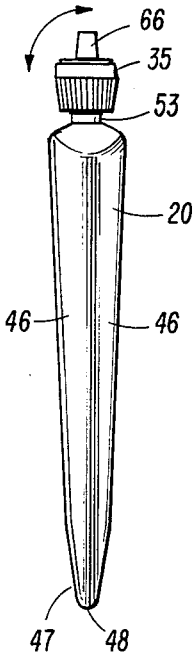
FIG. 4 is a end view of the container shown in FIG. 2.
Figure 5:
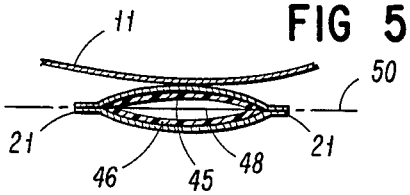
FIG. 5 is a partial and simplified sectional view of the carrier and armband taken along the section "5—5" in FIG. 1.

The longer edges 21 of the pocket 15 are preferably sewn by what is known as a surge stitch, shown at 40. FIG. 3 shows the surge stitch evident on only three edges of the pocket 15, namely the longer edges 21 and a bottom edge 41. The surge stitch 40 is absent from a top edge 42 of the upper portion 26 of the inner wall 22. The absence of the surge stitch at the top edge 42 is made possible by the upper portion 26 of the inner wall 22 being folded back on itself, as shown, for example, in the schematic material treatment view of FIG. 6. The top of the upper portion 26 is folded downward away from the pocket 15, such that the top or upper edge 42 is formed by the surface of the inner wall which faces the inside of the pocket 15. The folded over end of the upper portion 26 is then sewn to the armband 11 as herein described. The advantage of such apparently minor deviation may be better understood from a brief reference to FIG. 5. The downward sectional view of FIG. 5 shows a central inner wall portion 45 of the pocket 15 to be substantially in contact with the armband 11, hence with the wearer's arm. In an upward direction, sectioned off in FIG. 5, such contact of the central inner wall portion 45 continues essentially to the top edge 42 of the upper portion 26, largely as the result of the elliptical cross section of the flask and its oval-shaped curvature of flask walls 46. The top edge 42, particularly in extending above the upper peripheral edge 28 of the armband 11, will most likely come into contact in its center, as an uppermost extreme of the central inner wall portion 45, with the wearer's upper arm. The surge stitch may, however, be considered somewhat of an irritant, particularly by some persons with sensitive skin. In this respect an advantageous interaction between the flask 20 and the pocket bring about results which avoid irritating contact of the surge stitched longer edges 21 and the bottom edge 41 of the pocket 15 with the wearer's arm. The oval or elliptical cross-sectional shape of the flask 20 and how the flask 20 is carried in the pocket 15 needs to be examined to fully understand the advantage. In reference again to FIG. 5 and to an end view of the flask 20, as shown in FIG. 4, a base 47 of the flask 20 is wedge shaped, the sides of the base tapering to intersect at a lower edge 48. Though FIG. 4 shows a slight downward taper in the substantially cylindrical shape of the flask 20, such downward taper typically present only to a slight degree. Also, any taper in the cylindrical cross section may be the result of molding practices. The taper becomes indistinguishable when liquid is contained in the flask 20 and the pressure of the liquid bears outwardly against the walls 46 of the flask 20.

As the flask 20 is inserted into the pocket 15, the bottom edge 41 of the pocket 15 tends to conform to the position of a lower edge 48 of the base 47. As shown in FIG. 5, such conformance spaces even the bottom edge 41 away from the wearer's arm, as shown by the centerline 50 in FIG. 5. Also in reference to FIG. 5, the longer edges 21 of the pocket 15 are spaced well away from the wearer's arm. The pack cloth material of the pocket 15 exhibits a natural tendency to retain the oval-like shape, when the flask 20 is removed for a brief period. Consequently, a slight spacing between the inner wall 22 and the outer wall 23 facilitates reinserting the flask 20 after its removal.

Figure 6:
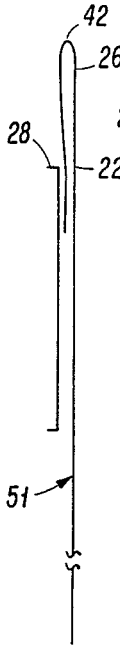
FIG. 6 is a schematic end view of elements of the armband and carrier during manufacture of the armband and carrier in accordance with the invention.
Figure 7:
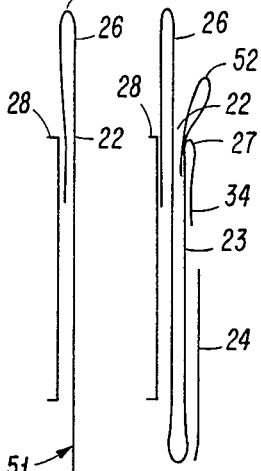
FIG. 7 is a schematic end view of elements of the armband and carrier similar to that in FIG. 6, but depicting same at a more advanced state of manufacture than that in FIG. 6.

Referring to FIGS. 6 and 7, the attachment of the pocket 15 to the armband 11 is illustrated in reference to the completion of the pocket. Though described in terms of their physical relationship, the inner wall 22 and the outer wall 23 are initially cut as a continuous long strip 51 of pack cloth material. The upper portion 26 is first folded over on itself as shown in FIG. 6, whereupon the inner wall 22 is sewn to the armband 11 with the preferred rectangular sewing pattern 29 as previously described. Following the attachment of the inner wall 22 to the armband 11, the rim band is folded and sewn. An elastomeric band 52 (See FIG. 3) may be attached to the center of the rim band 34 at this time. The band 52 may be hooked over the cap 35 of the flask 20 to become seated at a flask neck 53 to retain the flask 20 within the pocket 15 as shown in FIG. 1. The partial wall forming the slip pocket 25 may also be overlaid at that time. The outer wall 23 is now folded upward onto the inner wall 22, and the lateral and base surge stitches 40 are sewn. It should be realized that in that the sewing pattern does not extent outward toward the longer edges 21, the armband 11 is readily folded out of the way to complete the surged stitches along the three edges 21 and 41.

Prior to the attachment of the pocket 15 to the armband 11, the armband itself has been sewn. Referring to FIG. 3, the upper and lower peripheral edges 28 and 33, respectively, have been folded over and sewn with cover seamer chain stitch 54. The chain stitch is a loose stitch which allows the elastomeric material to expand and contract as expected. Cut ends 56 and 57 of the armband 11 may then similarly be hemmed. The closure of the armband 11 is preferably accomplished by means of well known hook and loop fastener material. Preferably, a piece of loop material 58 of substantially the width of the armband 11 and of a convenient length (though possibly shorter than the width across the armband 11), is attached to an outer surface 59 of the armband 11 adjacent the end 56. A strip of correspondingly hook material 61 is attached to an inner surface 62 of the armband adjacent the end 57. The armband 11 may then be fastened to a person's arm by wrapping the band 11 about the upper arm. The armband 11 is adjusted by stretching its elastomeric material with a pull on the one end 57 with respect to the other end 56 to a comfortable degree of stretch, and then hooking the material 61 into the loop material 58, as indicated by the arrow 64 in FIG. 3.

The flask 20 is a commercially available plastic molded item, the shape of which appears adapted for rack storage. Consequently, the flask 20 has the wedge shaped, tapered base 47. The lower edge 48 is ideally suited to be inserted into the pocket opening formed between the inner wall 22 and the upper edge 27 of the outer wall 23 of the pocket 15. When the flask 20 is inserted into the pocket 15, the elliptical shape of the body of the flask 20 imparts its shape to the pocket 15. The shape of the flask 20, consequently, spaces the longer edges 21 and the bottom edge 41 away from the plane in which the inner wall 22 of the pocket 15 is attached to the armband 11. An elastomeric band 52 may be fastened over a neck 53 of the flask 20, or it may be preferred to carry the flask 20 without any means for retaining it. For normal use by a person running, the length of the flask 20 serves to retain the flask in its pocket 15.

The size of the flask 20 selected for use in the refreshment carrier 10 is one having a four-ounce liquid container volume. Collected data on studies of runners indicate that exercises like running cause a liquid depletion of approximately three to six ounces per fifteen minutes of activity. Therefore, a runner would carry the supply of liquid refreshment in the carrier 10 for a period of fifteen to twenty minutes before requiring its use. The selected size of the flask 20 and including four ounces of liquid to be used by a runner wearing the carrier 10 has a gross weight of approximately 6.25 ounces. The total weight consequently does not significantly add excess weight for the user to carry along while engaged in the activity.

The cap 35 of the flask 20 may be a typical screw cap, which is conveniently provided with a spout 66 which can be flipped open or closed by the runner as indicated by the arrow 67 in FIG. 4. An uppermost position of the spout 66 is an open position. Conversely, a lowermost position of the spout 66 flat with the top of the cap 35 closes off the spout. The person using the flask 20 may raise the flask 20 to face level, flip the spout with one finger into the open position and actually squirt liquid into the mouth while being engaged in running. Of importance is that in taking on liquid nourishment in this form, no vacuum sucking action by the lungs of the runner need to be exerted, saving the use of the runner's lungs for the most important function of steadily supplying oxygen to the body. The spout 66 can further be used to squirt liquid over the head or other body portions of the runner if so desired.

It has also been found that the reinforced rim band 34 of the outer pocket wall 23 will further the tendency of the pack cloth material to keep the pocket 15 open for ready reinsertion of the flask 20 after it has been used. With only slight practice, the opening is immediately found by feel without devoting a great deal of attention to the reinsertion of the flask 20 into the pocket 15. Thus, a runner may elect to use only a part of the available liquid as refreshment and, without difficulty, return the flask 20 to the pocket 15 for later, repeated use. The upper portion 26 of the inner wall 22 serves as a guide for guiding the lower edge 48 of the flask 20 into a gap between the inner wall 22 and the upper edge 27 of the outer wall 23.

In that the flask 20 is readily removable from and reinsertible into the pocket 15 without interruption of the activity, such as running, the carrier 10 offers a further advantage to runners. The flask 20 may be used as an exchange item at refreshment stations along a planned route. Inasmuch as the flask 20 can be picked up at such a station, stored in the carrier 10 and carried for a desired distance by the runner before use, location for refreshment stations can be strategically planned and time delays to take on liquid refreshment at refreshment stations may be avoided to optimize running times over the distance of a run.

Various changes and modifications in the structure of the described embodiment are possible without departing from the spirit and scope of the invention as defined by the terms of the claims appended hereto and reasonable equivalents thereof.

What is claimed is:

1. An assemblage forming a liquid refreshment carrier, which comprises:

at least one flask having a substantially cylindrical body of elliptical cross section between a top and a straight, lower edge of the flask, an opening including a closure at the top of the flask, the cylindrical body terminating in a tapered base of intersecting sides forming said straight, lower edge of the flask;

means for retaining said at least one flask, said means comprising inner and outer walls of flexible material, said inner and outer walls being attached to each other along a base and longitudinal, parallel edges, said means having at least one opening adjacent an upper edge of such outer wall, such inner and outer walls capable of being shaped to conform to the cylindrical body of elliptical cross section of the flask by insertion of said flask therebetween;

means, formed of a resiliently stretchable length of material having a length capable of being stretched circumferentially about a person's arm, for adhering resiliently stretched to such person's arm; and means for attaching the inner wall of the retaining means to the adhering means, said attaching means joining a central area of said retaining means, spaced from said longitudinal, parallel edges thereof, whereby such insertion of said flask between the inner and outer walls shapes the retaining means to space the base and longitudinally edges of the inner and outer walls from such person's arm when the adhering means is adhered resiliently stretched about such person's arm.

2. An assemblage according to claim 1, wherein the retaining means for at least one flask is a single pocket, formed of pack cloth, the inner and outer walls having a rectangular shape, said inner wall having an upper portion extending above said adhering means and above an upper edge of said outer wall, such that a surface of the inner wall facing the outer wall and disposed above the upper edge of the inner wall forms a guide surface for inserting the flask between the inner and outer walls.

3. An assemblage according to claim 2, wherein the upper portion of the inner wall is folded back on itself away from the pocket, the fold forming a seamless edge of the surface of the material which forms the interior of the pocket.

4. An assemblage according to claim 3, wherein the inner wall is attached to the adhering means by a rectangular sewing pattern spaced from the longitudinal edges of the inner wall and extending substantially across a width of the adhering means.

5. An assemblage according to claim 4, wherein the outer wall comprises a reinforced rim band adjacent an upper edge of the outer wall, said rim band being a folded over portion of the outer wall.

6. An assemblage according to claim 5, wherein the pocket further includes an outer slip pocket formed of a third, partial wall having a sloped upper wall attached by its edges to the edges of the outer wall.

7. An assemblage according to claim 3, wherein the closure of the flask is a screw cap including a flip-open spout for squirting liquid from the flask into the mouth of the user.

8. An assemblage according to claim 1, wherein the at least one flask is a plurality of flasks, and each of the plurality of flasks are interchangeably insertible into the retaining means.

9. A liquid refreshment carrier comprising:

a liquid dispenser having a length between a top and a lower edge thereof, an elongate, cylindrical shape of elliptical cross section between said top and lower edge, said cylindrical shape terminating in a wedge like base adjacent said lower edge, and a cap including a spout at the top of said liquid dispenser;

an armband of elastomeric material, the armband having a circumferential length adapted to elastically extend about an upper arm of a person and a width adapted to extend across and cover contours of muscular structure of such person's upper arm;

a pocket for receiving said liquid dispenser, the pocket having inner and outer walls of flexible sheet material of rectangular shape and being attached to each other along a lowermost edge and longer, parallel side edges of the rectangular shape of the pocket, such longer edges of the pocket extending across the width of the armband, the inner wall of said pocket being attached to the armband along a central adjacent portion of the inner wall spaced from the side edges of the pocket and having a length longer than the outer wall of the pocket and longer than the length of the liquid dispenser, the upper edge of the inner wall extending above the upper edge of the outer wall, the upper portion of the inner wall being interposed between any such liquid dispenser disposed in the pocket and the upper arm of a person wearing the liquid refreshment carrier.

* * * * *